United States Patent [19]

Skow

[11] 4,337,730

[45] Jul. 6, 1982

[54] HOT WATER PROBE

[75] Inventor: Lynn R. Skow, North Branch, Minn.

[73] Assignee: Gemini Systems, Inc., Rush City, Minn.

[21] Appl. No.: 197,548

[22] Filed: Oct. 16, 1980

[51] Int. Cl.[3] ..... F22B 33/00

[52] U.S. Cl. ..... 122/20 A; 110/234

[58] Field of Search ..... 110/234; 122/20 B, 20 A, 122/6 B; 126/132; 165/142

[56] References Cited

U.S. PATENT DOCUMENTS

| | | | |
|---|---|---|---|
| 869,616 | 10/1907 | Blair, Jr. | 122/6 B |
| 1,543,940 | 6/1925 | Mathesius | 122/6 B |
| 1,628,537 | 5/1927 | Fisher | 110/234 X |
| 1,830,318 | 11/1931 | Harlan | 122/6 B |
| 2,252,606 | 8/1941 | Wick, Jr. | 122/6 B |
| 3,896,992 | 7/1975 | Borovina et al. | 122/20 B X |
| 4,088,113 | 5/1978 | McIntire et al. | 126/132 |
| 4,116,379 | 9/1978 | Movick | 237/1 A |
| 4,127,107 | 11/1978 | Melgeorge | 126/361 |
| 4,154,210 | 5/1979 | Jaymes et al. | 126/34 |
| 4,210,101 | 7/1980 | Touze | 122/20 B |
| 4,226,195 | 10/1980 | Lindroos | 110/234 |
| 4,240,362 | 12/1980 | Wigdahl | 110/234 |
| 4,245,982 | 1/1981 | Radoux et al. | 122/6 B |

*Primary Examiner*—Edward G. Favors

[57] ABSTRACT

A hot water probe for use with a wood or other solid fuel burning appliances (stoves, furnaces, fireplaces, etc.) to provide supplemental hot water heating whereby the use of natural gas or other non-renewable fuel can be conserved. The probe may comprise a pair of elongated, coaxial tubes of a predetermined length which extend outwardly from a header block which contains an inlet chamber sealingly coupled to the inner one of said pair of coaxial tubes and an outlet chamber sealingly coupled only to the outer one of said pair of coaxial tubes. The tubular portion of the probe is fitted through a hole formed in a wall of the appliance and it extends for a predetermined distance into the firebox at a desired level relative to the flame. The header block may be bolted or otherwise affixed to the outer side wall of the appliance. A connection is then made between a water outlet of the water heating tank and the inlet chamber of the header. Likewise, a connection is made between the outlet chamber of the header and an inlet to the water heating tank. As water circulates through the central tube and back through the outer tube of the probe, it is heated by the fire in the stove, furnace or fireplace before being returned to the water heating tank. The specification also details how plural probes may be cascaded to provide an increased heating capacity.

4 Claims, 4 Drawing Figures

HOT WATER PROBE

BACKGROUND OF THE INVENTION

I. Field of the Invention

This invention relates generally to auxiliary hot water heating apparatus and more specifically to the design of a probe device adapted to be fitted into the firebox of a solid fuel burning appliance and plumbed to a conventional hot water heating tank so that the heat generated by the burning solid fuel can supplement or at times eliminate the need to burn natural gas or the like in the hot water heating function.

II. Discussion of the Prior Art

As the price of natural gas, other home heating fuels and electricity increases, more and more home owners are becoming "energy conscious" and are looking to ways for reducing their home heating costs. A popular approach, as reflected by continually increasing sales, is the use of an auxiliary solid fuel burning appliance which may be coupled into the home heating system along with the conventional natural gas or fuel oil fired unit. While this approach results in a reduction in the amount of non-renewable fuel consumed, a still further reduction can be achieved if the home hot water heating needs could be supplied without excessive use of natural gas or the like. This is the problem addressed by the present invention.

The present invention provides an attachment for an existing solid fuel burning appliance whereby the heat produced by burning of the fuel may be used not only to provide home heating but also to supply part or all of the occupant's demands for hot water.

SUMMARY OF THE INVENTION

In its simplest form, the preferred embodiment of the present invention comprises an elongated probe which is adapted to be connected through a wall of the solid fuel burning furnace or the like so as to extend into the firebox and subjected to the high heat given off by the burning of the wood, coal or other solid fuel. In one arrangement, the probe is comprised of first and second concentric tubular elements which are coupled at a first end to a header block which is arranged to be fastened to the side wall of the solid fuel burning appliance. The distal end of the outer tube is sealed while the same end of the inner tube is open. The lumen of the inner tube is coupled to an inlet chamber in the header block while the lumen of the outer tube is sealingly joined to an outlet chamber in that same block. The inlet and outlet chambers have corresponding ports which are provided with threads so that connections may be made between a water outlet of a hot water tank and the inlet port of the probe device. Similarly, a connection is made between the outlet port of the probe device and an inlet connection to the hot water tank. When in operation, then, water from the hot water tank is made to flow down the central tube of the probe, out its open distal end and back through the lumen of the outer tube of the probe where it is returned to the hot water tank. In passing through the probe which, as mentioned, is disposed in the firebox of the appliance, the water is heated before being returned to the hot water tank.

In an alternative arrangement, the probes are designed so that either one or more than one such probe may be cascaded to provide greater heat exchange surface.

In a still further alternative arrangement, rather than employing two coaxial tubes to define first and second flow paths traversing the length of the probe, a simple plate member is disposed within a single outer tube and is welded or otherwise sealingly connected to the inner side walls of the outer tube. Water introduced through an inlet port on one side of the plate divider will flow down the length of the outer tubes towards its closed ends and then will be returned on the opposite side of the divider to the outlet port in the header.

OBJECTS

It is accordingly the principal object of the present invention to provide an attachment for a solid fuel burning appliance, such as stoves, furnaces, fireplaces, etc., whereby the burning of that fuel can also be used to supplement or totally supply the user's demand for hot water.

Another object of the invention is to provide, in kit form, probe apparatus which may be easily installed on an existing solid fuel burning appliance and coupled to a home hot water heating tank whereby the hot water demands can be met through the burning of the solid fuel within the appliance.

Still another object of the invention is to provide a low-cost, easy-to-install attachment for a fuel burning appliance whereby hot water demands can be satisfied, either in whole or in part, by extracting heat from the furnace as the fuel therein is consumed.

Still further objects and advantages of the invention will become apparent to those skilled in the art from the following detailed description of a preferred embodiment when taken in conjunction with the accompanying drawings in which like numbers in the several views refer to corresponding parts.

DESCRIPTION OF THE PREFERRED EMBODIMENT

Figure 1:
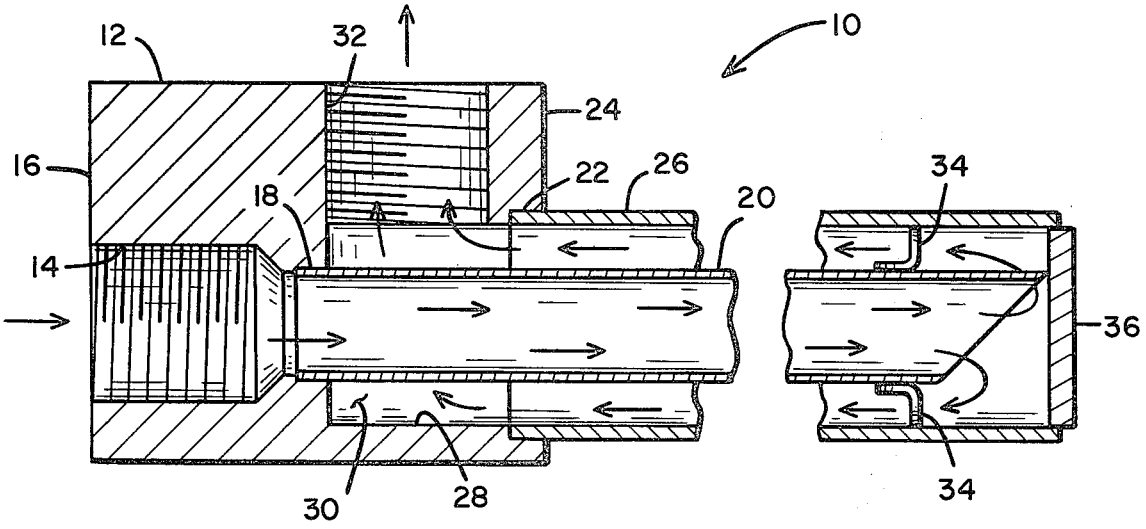
FIG. 1 is a cross-sectional view of a first embodiment of the invention.

Referring first to FIG. 1, there is indicated generally by numeral 10 the design of a heat exchanger probe in accordance with a first embodiment of the invention. The probe 10 is seen to comprise a header block 12 which may be formed from a suitable metal or plastic and which has a bore 14 formed inwardly of the rear face 16 thereof, the bore 14 forming an inlet chamber. The bore 14 terminates in a counterbore 18 of a diameter sufficient to allow the outside diameter of a center or inner tube 20 to be tightly and sealingly fitted therein. A further concentric bore 22 is formed inwardly of the front face 24 and the bore 22 is of a diameter to frictionally receive the outside diameter of an outer tubular member 26. A further bore of slightly smaller diameter indicated by numeral 28 is formed concentrically with the bore 22 and extends inwardly from the front face 24 so as to define an outlet chamber in the header block 12. Still another bore 32, which may be internally threaded, communicates with the outlet chamber 30 and comprises an outlet port.

With no limitation intended and merely for the purpose of illustration, the header block 12 may be two inches high, one and five-eighths inches wide and two and one-fourth inches long. The tube 26 may have an outside diameter of one and one-fourth inches and have a sixteen gauge wall thickness. The inner tube 20 may, in turn, have a three-quarter inch outside diameter and be fabricated from twenty gauge wall thickness tubing. The overall length of the probe may be in the range of from twenty-four inches to thirty-six inches, again with no limitation to this range being intended.

In order to support the inner tube 20 concentrically with the outer tube 26, a plurality of centering clips as at 34 may be welded or otherwise attached to the outer surface of the inner tube 20, the clips being dimensioned to abut the ID of the outer tube 26. Disposed in the distal end of the outer tube 26 is a circular plug member 36 which blocks the opening of that tube.

Figure 2:
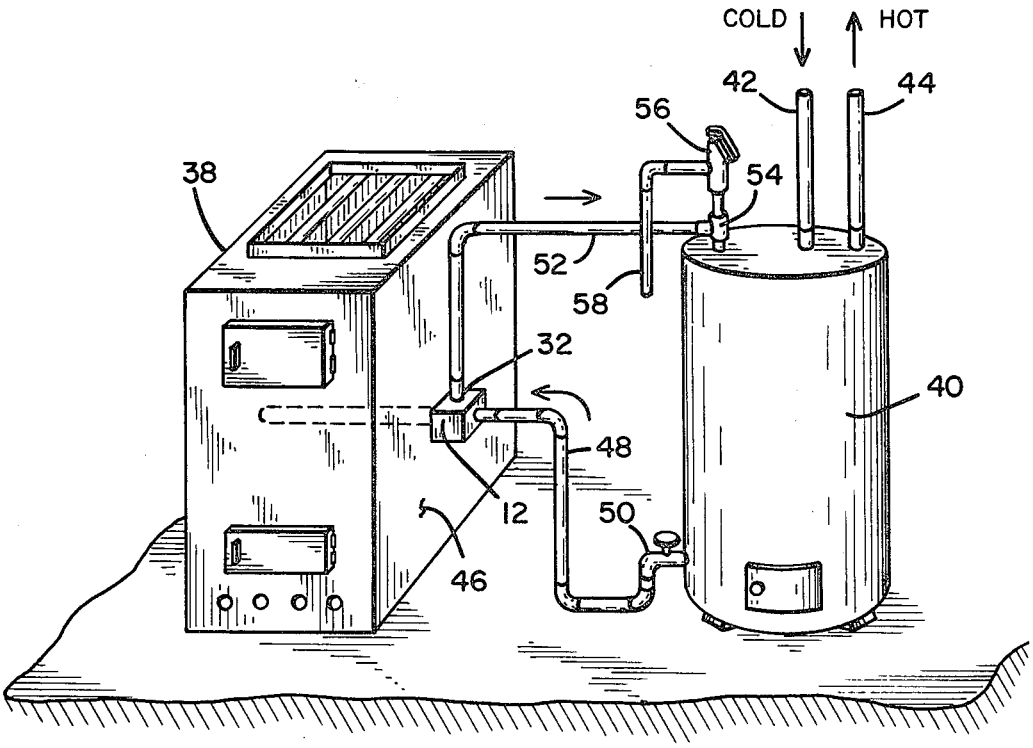
FIG. 2 is a perspective view showing the manner in which the embodiment of FIG. 1 is used.

With reference to FIG. 2, there is shown a perspective view of a typical residential or commercial heating system in which the present invention finds use. Indicated by numeral 38 is a solid fuel burning furnace which may, for example, be of the type described in the Skow U.S. Pat. No. 4,201,187, which is assigned to the assignee of the present invention. Numeral 40 identifies a hot water heating tank which typically is used to supply the user's demand for hot water and which may be an electric unit or the type which burns natural gas or other similar type of fuel. Cold water is brought into the tank 40 by way of the inlet pipe 42 and hot water may be drawn through the outlet pipe 44 when a hot water faucet in the building is opened.

The header block 12 is affixed to the side wall 46 and the tubular probe portion extends horizontally through that side wall and into the firebox (not shown) of the furnace 38. A vertical mounting of the probe is also contemplated, so long as the length of the probe is exposed to the heat. A suitable plumbing connection is made between an outlet of the water tank 40 and the inlet port 14 of the probe device. This plumbing connection is indicated generally by numeral 48. In this regard, conventional home hot water heating tanks normally have an outlet spigot as at 50 disposed proximate the base of the tank and by connecting to this spigot, it is possible to tap into the water supply in the tank 40 without the need for drilling and tapping an auxiliary hole to gain access to the water contained in it.

In a similar fashion, a plumbing connection 52 joins the outlet port 32 of the probe device 10 to a water inlet connection 54 on the hot water tank 40. In this regard, hot water heating tanks of the type described normally have a relief valve 56 associated therewith which couples through a pipe 58 to a sewer drain (not shown). A convenient point for connecting the outlet port 32 of the probe to the water tank is at the junction between the relief valve 56 and the point at which the inlet of that valve connects to the hot water tank.

With reference to FIGS. 1 and 2, then, it can be seen that water may be made to flow through the inlet port 14 of the probe header 12, through the lumen of the inner tube 20, out its open end and back through the lumen of the outer tube 26 to the outlet chamber 30. In that the tubular members 20 and 26 are disposed above the flame in the firebox of the furnace 38, the water is heated as it traverses the aforementioned path and it is returned to the water heater via the plumbing connection 52.

The plumbing layout shown in FIG. 2 should be considered as illustrative of the principles only and in an actual installation, the connections between the hot water unit and the probe may be considerably different. For example, a pump system with suitable controls and relief valves may be disposed in the loop to ensure proper circulation and safety. Alternatively, a gravity system having a tempering tank disposed above the level of the probe with a cold water inlet, a hot water outlet to the building's water heater tank, and connections to and from the probe device has been found to provide satisfactory performance.

The amount of heat transferred to the water as it traverses the probe is, of course, dependent upon the surface area of the probe, the flow rate of the water and the temperature of the fire. Where a greater heating capacity is desired over that which one can obtain using a single probe of the type shown in FIG. 1, resort may be made to the embodiment of FIG. 3 which illustrates the manner in which plural identical probes may be cascaded.

Figure 3:
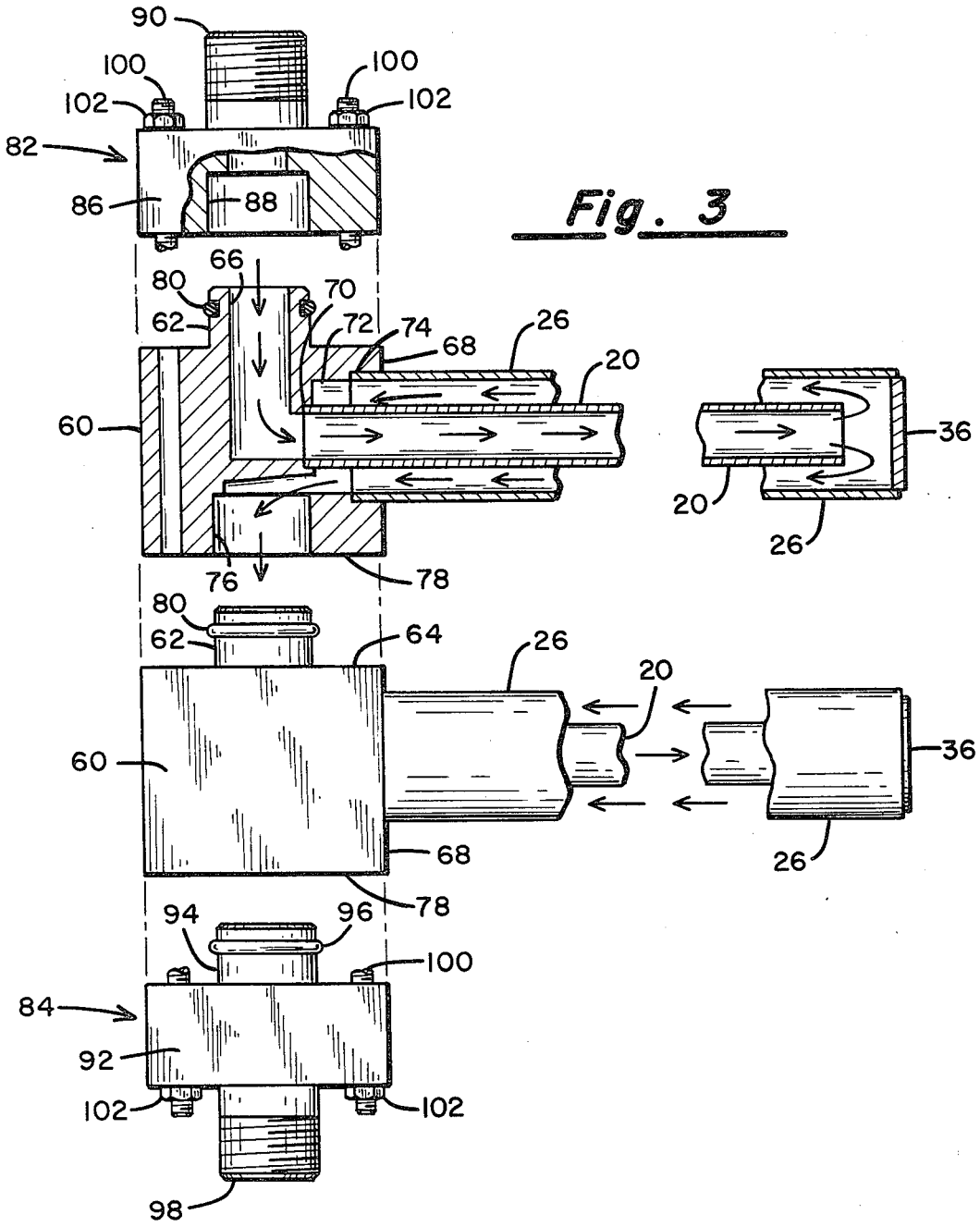
FIG. 3 is an alternative embodiment of the present invention.

Referring to FIG. 3, the probe may comprise a header 60 again in the form of a generally rectangular block and having a cylindrical projection 62 formed on the upper face 64 of the header. A central bore 66 is formed through the projection 62 and into the center of the header block 60. Formed in the front face 68 are a series of concentric bores of progressively increasing diameter. Specifically, the three concentric bores are identified by numerals 70, 72 and 74 respectively. The bores 70 and 74 are adapted to receive in a fluid tight fashion the outside diameter of the inner tube 20 and the outside diameter of the outer tube 26, respectively. The innermost bore 70 communicates with the bore 66 formed through the projection 62 allowing water entering the bore 66 to flow through the lumen of the inner tube 20.

The bore 72 joins to a further bore 76 formed in the bottom surface of the header block 60. Thus, the bore 72 comprises an outlet chamber communicating with the outlet port 76. The diameter of the bore 76 is of a size so as to receive the projection 62 of a further probe device. An O-ring as at 80 may be employed to provide a fluid tight coupling between mating adjacent probes.

When two probes are so joined, water introduced through the inlet port 66 of the first probe will flow through the lumen of the inner tube 20 and back through the lumen of the outer tube 26 of that first probe and through its outlet chamber and port 76 into the inlet bore 66 of the second probe assembly. The flow continues down the central tube 20 of that second probe and back through the lumen of its outer tube 26 where it again exits through the outlet port 76 of that second probe.

It is, of course, obvious that more than two such identical probe devices may be coupled, one to the other. Completing the assembly is a clamping and adapter arrangement in the form of a female adapter member indicated generally by numeral 82 and a male adapter member indicated generally by numeral 84. The female adapter comprises a rectangular block 86 having a cylindrical bore 88 formed in the bottom surface thereof, the diameter of this bore being of a size to receive the male projection 62 of a probe header 60. Again, an O-ring 80 may be used to provide a fluid tight coupling. The bore 88 communicates with a threaded input connection 90.

With continued reference to FIG. 3, the male adapter 84 comprises a block member 92 having a cylindrical extension 94 projecting upwardly from the top face thereof. Again, the diameter of the extension 94 is the same as the diameter of the extensions 62 on the probe headers 60 so that it can mate with the output port 76 of those headers. Again, an O-ring as at 96 may be provided on the extension 94 to assure a fluid tight coupling. Formed on the opposed surface of the block 92 is a threaded outlet connection 98. A central bore extends through the cylindrical extension 94 and through the threaded outlet connection 98.

To hold plural probe segments together, it has been found convenient to drill a plurality of holes through the blocks 86, 60 and 92 so that when the parts illustrated in FIG. 3 are coupled together, these holes will be aligned so as to receive threaded rods as at 100 which extend through all of the blocks. Nuts 102, when screwed onto these rods, then serve to hold the individual elements securely together.

The manner of utilizing the embodiment of FIG. 3 is perhaps self-explanatory in light of the explanation of the manner in which the embodiment of FIG. 1 is used. Suffice it to say, the plural probes extend through spaced apertures formed in a wall of the furnace 38 and the water inlet plumbing connection 48 is coupled to the threaded stem 90 of the female adapter while the outlet plumbing 52 connects to the threaded stem 98 of the male adapter. Those skilled in the art will also readily visualize how the probe(s) may be mounted in other solid fuel burning appliances.

Figure 4:
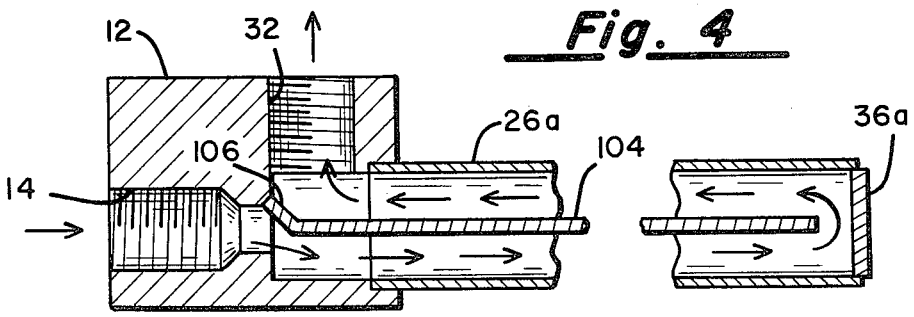
FIG. 4 illustrates a still further embodiment of the invention.

Referring to FIG. 4, an alternative arrangement is illustrated wherein the central tube 20 of FIG. 1 is replaced with a divider plate 104. The divider plate extends diametrically within the outer tube 26 and its proximal end is bent as at 106 so that the inlet port 14 formed in the header block 12 is disposed on one side only of the longitudinally extending divider plate 104. The distal end of the divider plate 104 falls short of the end 36 of the outer tube 26 allowing water to flow through the resulting opening and back along the opposite side of the divider plate 104 where it may exit through the outlet port 32 formed in the header 12.

In practice it has been found convenient to fabricate the tubes 20 and 26 from stainless steel. The header blocks 12 and 60 may be fabricated from cold rolled steel or even plastic, assuming that proper attention is paid to the temperatures incurred relative to the softening point of the plastic employed.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modifications, both as to equipment details and operating procedures can be effected without departing from the scope of the invention itself.

What is claimed is:

1. Water heating apparatus for use in heat transfer relation with the combustion chamber of a fuel burning appliance comprising, in combination:

a plurality of header members each including a block of material having a first tubular connector extending outwardly from one surface thereof, a second tubular connector extending inwardly into an opposite surface thereof, said connectors being adapted for mutual interfitting, and a heat exchanger extending from another surface thereof to project into a combustion chamber, and providing a continuous path for fluid flow from an inlet connected to one of said connectors to an outlet connected to the other of said connectors, said header members being arranged in a succession with the first connector of each subsequent member interfitted in the second connector of a previous member;

first adaptor means including a first further block of material having a first further connector extending thereinto and adapted to interfit with the first connector of the initial member of said succession;

second adaptor means including a second further block of material having a second further connector extending therefrom and adapted to interfit in the second connector of the first member of said succession;

fastener means traversing said blocks for maintaining said connectors in interfitted relation to enable flow of liquid through said heat exchangers in succession;

and means for supplying water to one of said further connections and receiving water from the other of said further connectors after flow thereof through said heat exchangers.

2. A water heating probe for insertion in heat transfer relation into the combustion chamber of a solid fuel heating appliance, said probe comprising, in combination:

at least one header member including a block of material having a first tubular connector extending outwardly from one surface thereof and a second tubular connector extending inwardly into an opposite surface thereof;

a heat exchanger extending from another surface of said header member and providing a continuous path for flow of water from an inlet connected to one of said connectors to an outlet connected to the other of said connectors;

first adaptor means including a first further block of material having a first further connector adapted to interfit with one of said connectors of said header member;

second adaptor means including a second further block of material having a second further connector adapted to interfit with the other connector of said header member;

fastening means traversing said blocks for holding the connectors of said adaptor means in interfitted relation with the connectors of said header means;

and means for supplying water to one of said further connectors and receiving water from the other of said further connectors after flow thereof through said heat exchanger.

3. Apparatus according to claim 2 in which said heat exchanger comprises a pair of coaxial tubular members interconnected only at the ends thereof remote from said header member.

4. Apparatus according to claim 2 in which said heat exchanger comprises a pair of laterally apposed channels interconnected only at the ends thereof remote from said header member.

* * * * *